US008172115B1

(12) United States Patent
Mulhauser et al.

(10) Patent No.: US 8,172,115 B1
(45) Date of Patent: May 8, 2012

(54) HAIR BUILDING SOLIDS DISPENSER FOR ONE HANDED OPERATION

(75) Inventors: Paul Mulhauser, New York, NY (US); Kyungmin Andy Lee, Wyckoff, NJ (US); Mark Kress, Westport, CT (US)

(73) Assignee: Spencer Forrest, Inc., Los Angeles, CA (US)

( * ) Notice: Subject to any disclaimer, the term of this patent is extended or adjusted under 35 U.S.C. 154(b) by 560 days.

(21) Appl. No.: 12/100,677

(22) Filed: Apr. 10, 2008

(51) Int. Cl.
*B05B 11/06* (2006.01)

(52) U.S. Cl. ..... 222/633; 222/209; 222/401; 239/338

(58) Field of Classification Search ..... 222/630–633, 222/207, 209, 389, 401, 400.8, 373; 424/45–47; 239/338, 349; 604/58
See application file for complete search history.

(56) References Cited

U.S. PATENT DOCUMENTS

| | | | | | |
|---|---|---|---|---|---|
| 277,900 | A * | 5/1883 | Hayes | 222/633 |
| 1,142,636 | A * | 6/1915 | Singer | 222/633 |
| 1,776,489 | A * | 9/1930 | Cobb | 222/633 |
| 1,852,685 | A * | 4/1932 | Tremblay | 222/633 |
| 2,098,160 | A * | 11/1937 | Perritt | 222/209 |
| 2,358,329 | A * | 9/1944 | Houghton | 222/633 |
| 4,880,161 | A * | 11/1989 | Wright | 239/330 |
| 5,894,960 | A * | 4/1999 | Rodden et al. | 222/207 |
| 6,616,067 | B1 * | 9/2003 | Hunter | 239/338 |
| 7,140,522 | B2 | 11/2006 | Kress | |
| D599,215 | S * | 9/2009 | Mulhauser et al. | D9/724 |
| 7,841,494 | B2 * | 11/2010 | Batinkoff et al. | 222/633 |
| 2008/0223879 | A1 | 9/2008 | Batinkoff et al. | |

FOREIGN PATENT DOCUMENTS

| | | | |
|---|---|---|---|
| GB | 748530 | A | 5/1956 |

* cited by examiner

*Primary Examiner* — Frederick C. Nicolas
(74) *Attorney, Agent, or Firm* — Venable LLP; Stefan J. Kirchanski

(57) ABSTRACT

A dispenser for hair building solids can be readily operated and aimed with one hand. A bulb that provides air for suspending the solids is located directly on top of a dispenser body. The bulb can be depressed by a single finger when the device is held in one hand. When the compressed air exits the bulb, it follows a direct straight downward pathway to the surface of the hair building solids. Air exiting the bulb passes through an air injecting orifice that is directed towards the surface of a mass of hair building solids suspending the solids within the turbulently pressurized container, which solids are then directed smoothly by the domed undersurface of the dispenser body into the straight bore of a short nozzle. The path followed by the solids is without bends thereby avoiding clogging.

5 Claims, 7 Drawing Sheets

Prior Art

HAIR BUILDING SOLIDS DISPENSER FOR ONE HANDED OPERATION

U.S. GOVERNMENT SUPPORT

N/A

BACKGROUND OF THE INVENTION

1. Area of the Art

The present invention is in the area of cosmetic treatments for hair loss and more specifically involves a dispenser for hair building solids.

2. Description of the Background Art

Most people are not happy with the change in their appearance occasioned by loss of hair and changes in hair quality and color. One has only to look at the number of products directed towards improving the characteristics of hair that one can find in a typical drug store. In the United States alone billions or dollars are spent each year on hair related products.

Although there are a range of options for treating hair loss ranging from drugs (relatively ineffective and prone to side effects) to surgical methods (expensive and often painful), many people have opted for a cosmetic approach that does not cure hair loss but merely masks it. The simplest cosmetic approach involves treating the areas of thinning hair with a masking composition that minimizes the appearance of a bald region by coloring the scalp to match the hair. Such a treatment will minimize the appearance of a thinning region, but it can be difficult to apply such a coloring agent along a thinning hair line with convincing results. Furthermore, this approach is less effective for white or gray hair as the coloration of the scalp does little to blend in the thinning spot. In addition, this cosmetic approach does little to increase the apparent thickness of the hair.

Therefore, a more satisfactory cosmetic approach is the application of short colored fibers and/or powder and particles, known as hair building solids to the scalp areas in need of cosmetic treatment. As used herein hair building solids includes all types of fibers, powder and/or particles used to enhance the appearance of hair thickness and to disguise the appearance of hair thinness. Ideally, the solids are colored to match the natural hair color of the user and exhibit properties such that static electricity or other similar interactions allow them to adhere to the hair strands as well as the scalp. Treatment with hair building solids can result in a very convincing appearance of thickened hair as well as a reduction in the obviousness of balding regions.

The most apparent difficulty with the use of hair building solids is the application of the solids to the scalp. The usual means of application is to sprinkle the solids over the regions in need of treatment. For this reason the solids are often packaged in salt shaker-like containers. However, it may be difficult for the user to evenly sprinkle the material in the proper areas. At least one inventor has attempted to solve this difficulty by developing a device to spray the material into position. U.S. Pat. No. 6,168,781 to Ukaji et al. shows a spraying device which uses a source of pressurized gas propellant to deliver a stream of hair building solids by directing the gas stream over the surface of a container filled with the material. The gas stream picks up solids and propels them out a nozzle. U.S. Pat. No. 7,140,522 to Kress (one of the present inventors) discloses a simple hand operated device for dispensing hair building solids.

None of the earlier devices for dispensing hair building solids are ideal. That of Ukaji et al. requires an often heavy and bulky source of propellant. The velocity of compressed propellant may be difficult to control. The dispenser of Kress is difficult to operate and aim with one hand.

SUMMARY OF THE INVENTION

This hair building solids dispenser solves several problems experienced by earlier devices. The problem of single handed operation is solved by the position of a bulb that provides air for suspending the solids. The bulb is located directly above and on top of a dispenser body which acts as the lid for a container of hair building solids. This allows the device to be held, operated and aimed with one hand. The bulb is placed to allow it to be depressed by a single finger. When the compressed air exits the bulb it follows a direct straight downward pathway to the surface of the hair building solids. This allows both maximum force if needed as well as subtle control of smaller gentle puffs. The air exiting the bulb passes through a dispensing nipple that is part of the dispenser body. The nipple is directed towards the surface of a mass of hair building solids in the container and suspends the hair building solids. The undersurface of the dispenser body forms a domed region that is continuous with the inner space of the container. Depending on the embodiment a small transition chamber may open into the domed region. The turbulent suspended solids are directed smoothly by the domed undersurface of the dispenser body right into the bore of a nozzle.

A relatively short nozzle projects from the dispenser body with the straight bore of the nozzle connecting directly to domed region or the transition chamber. The suspended solids move directly into a straight bore continuous, travel the length of the nozzle and emerge into the open air. There are no bends in the pathway to result in clogging deposition of hair building solids. When the dispenser is grasped with one hand the index finger can be aligned with the short nozzle. Thus, when the dispenser is operated by depressing the surface of the bulb with the index finger, the finger naturally points to where the dispensed solids will be directed. This arrangement naturally allows a user to direct the dispensed solids to the desired location. Simple one handed operation distinguishes this dispenser.

DESCRIPTION OF THE FIGURES

FIG. 7A shows the insert from above; and FIG. 7B shows the insert from below.

DETAILED DESCRIPTION OF THE INVENTION

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an improved dispenser for hair building solids.

Figure 1:
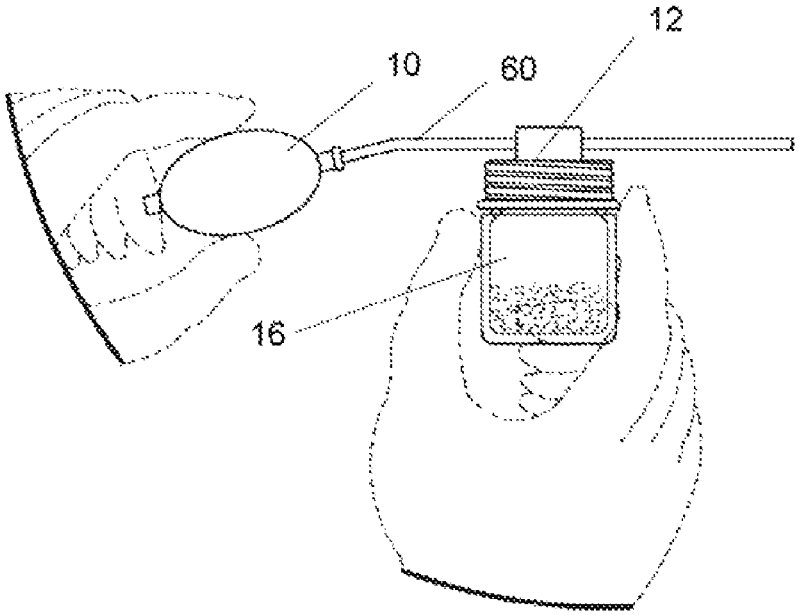
FIG. 1 shows a prior art hair building dispenser.

The dispenser of the present invention solves several problems inherent in prior art hair solid dispensers. The goal of the device is to simplify realistic placement of hair building solids on the scalp to disguise areas of thinning hair. Prior devices such as the device shown in U.S. Pat. No. 7,140,522, all of which is incorporated herein by reference. FIG. 1 shows such a device which consists of a bulb 10 which is squeezed by one hand to provide an air blast to suspend hair building solids in a container 16 and propel them out of the orifice 36 of a nozzle 14. Because the bulb 10 is located distally from the container 16, use of the device generally requires two hands—one to support the container 16 and one to squeeze the bulb 10. This makes it relatively difficult to correctly aim the nozzle 14 because ideally one would like to hold a hand mirror at the correct angle to reflect the top of ones head onto a stationary (e.g., medicine cabinet) mirror. Such devices are ideally operated by a person other than the person receiving the hair building solids, for example, by a beautician. However, most users do not have the luxury of having someone available to help with application. Therefore, they must clumsily struggle to use the device with two hands.

Second, because the bulb 10 is distal to the container 16 boundary layer resistance within the conduit 60 and bends within the airflow pathway may reduce the air blast to a force suboptimal to suspend the hair building solids—particularly when their level becomes low in the container 16. Finally, bends in the airflow pathway leading to the nozzle 14 may cause the solids to clump and obstruct the flow of the suspended material.

Figure 2:
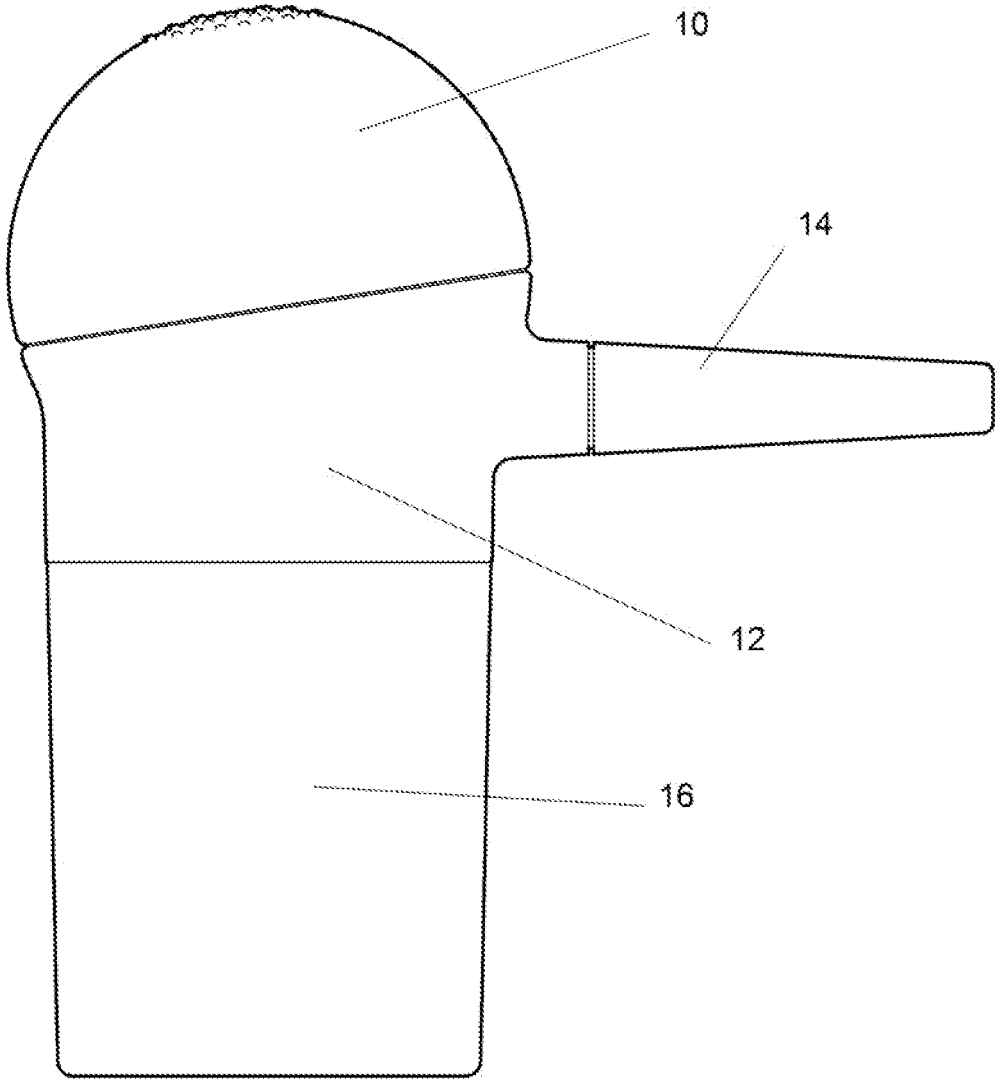
FIG. 2 is side view of the dispenser of the present invention.

These problems are solved by the novel hair building solids dispenser of the present invention. As shown in FIG. 2 the device consists of a bulb 10, a dispenser body 12 which is screwed onto or otherwise removably attached to a container 16 filled with hair building solids. A dispensing nozzle 14 protrudes from the dispenser body 12. The container of hair building solids 16 is generally sold separately from the dispenser body 12 and is closed by a cap. To use the solids, the cap is removed and one end of the dispenser body 12 is attached in place of the cap. The bulb 10 is integral with the dispenser body 12 attached at the end of the body 12 opposite the container 16 so that the combination can easily be grasped with the thumb and fore, ring and little fingers of one hand leaving the index finger free to operate (depress) the bulb. This leaves the other hand free to manipulate the hair or hold a mirror to facilitate application of the hair building solids.

Figure 3:
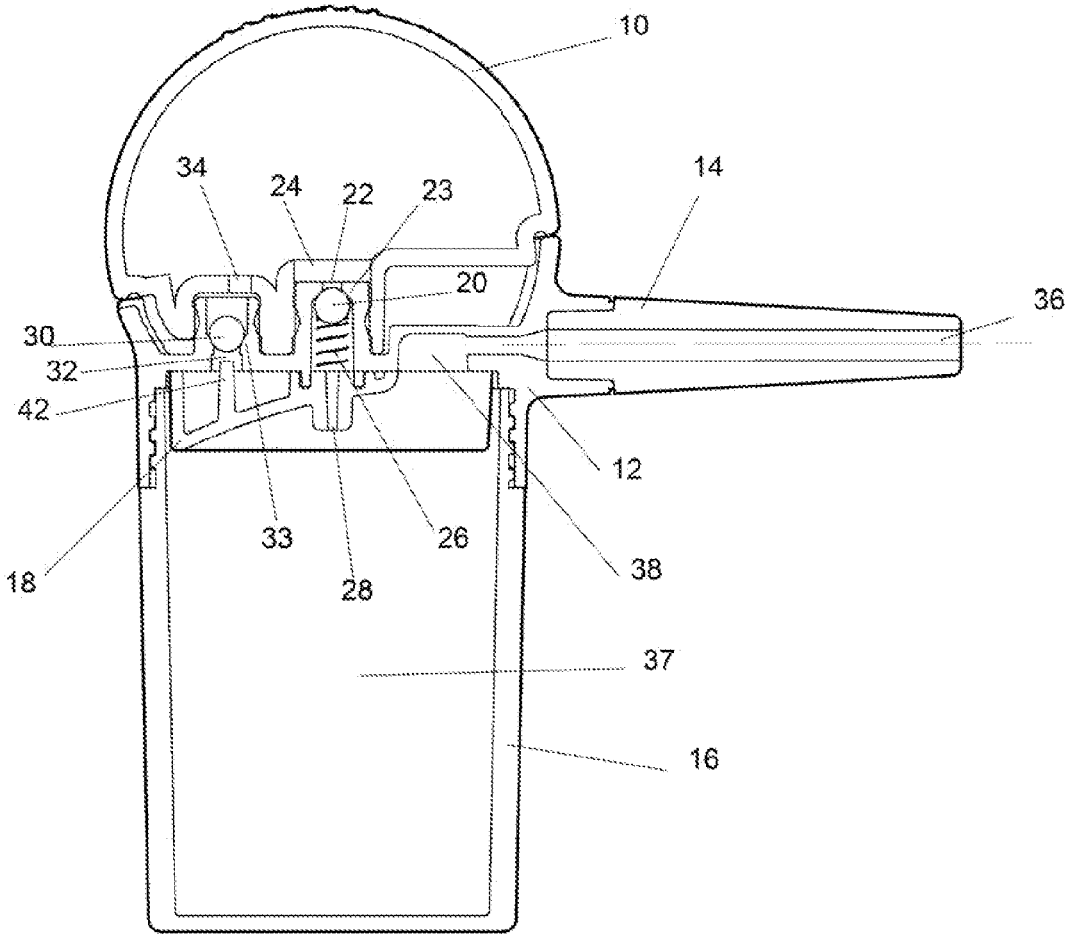
FIG. 3 is a cross-sectional view of the device of FIG. 2.
Figure 7A:
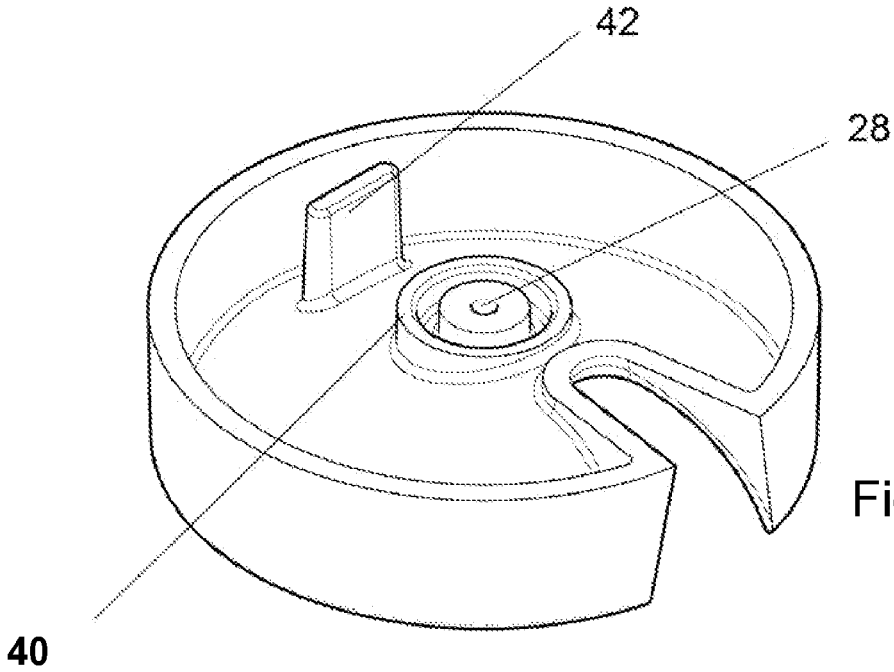
FIG. 7A-B show perspective views of the spray body insert.
Figure 7B:
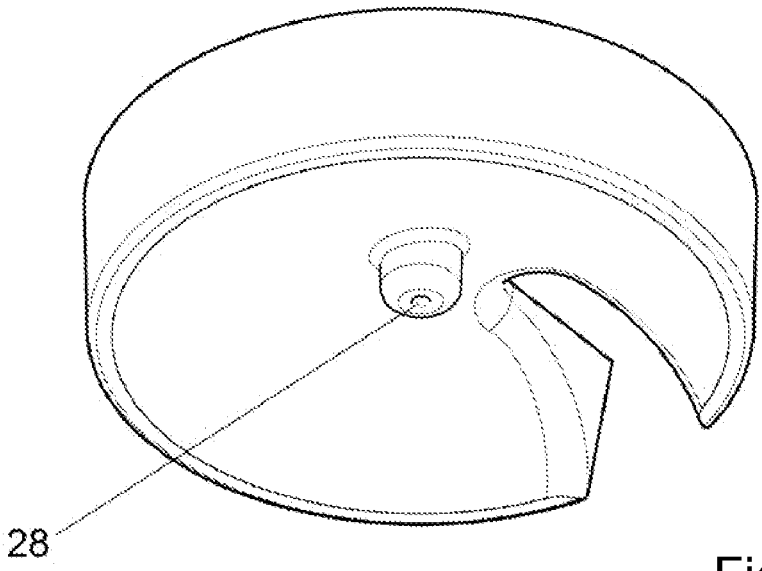

FIG. 3 which is a cross-section illustrates further advantageous features of the device. The bulb 10 is molded to fit around various structural details of the dispenser body 12. The bulb 10 is held in place by resiliently gripping these structures although a suitable adhesive can also be applied to keep the bulb 10 in place. The bulb 10 contains a central dispensing opening 24 in line with an air injecting orifice 22 in the dispenser body 12. The air injecting orifice 22 is closed by an injecting valve ball 20, seated in an injecting valve seat 23 and kept normally closed by a bias spring 26. Together the ball 20, the seat 23 and the spring 26 constitute a one-way air injecting valve which is integral with the air injecting air path. A molded insert 18 (shown in perspective view in FIGS. 7A and 7B) is aligned with and attached to the underside of the dispenser body 12. The insert 18 provides an air injecting orifice 28 or nipple (see also FIG. 7B). Note that the air injecting orifice (and the entire air injecting passageway which comprises the opening 24, the one way valve 20, 23, 26 and the air injecting orifice 28) are preferably located at the geometrical center of the dispenser body 12 plus insert 18 combination so that the stream of air strikes the middle of the solids 42 in an attached container 16. The upper end of the air injecting orifice/nipple 28 (see FIG. 7A) is surrounded by a collar 40 which is designed to trap and guide the lower end of the bias spring 26. The upper surface of the insert 18 also bears an alignment peg 42 (see FIG. 7A) which radially aligns the insert 18 with the dispenser body 12 during assembly.

Figure 5:
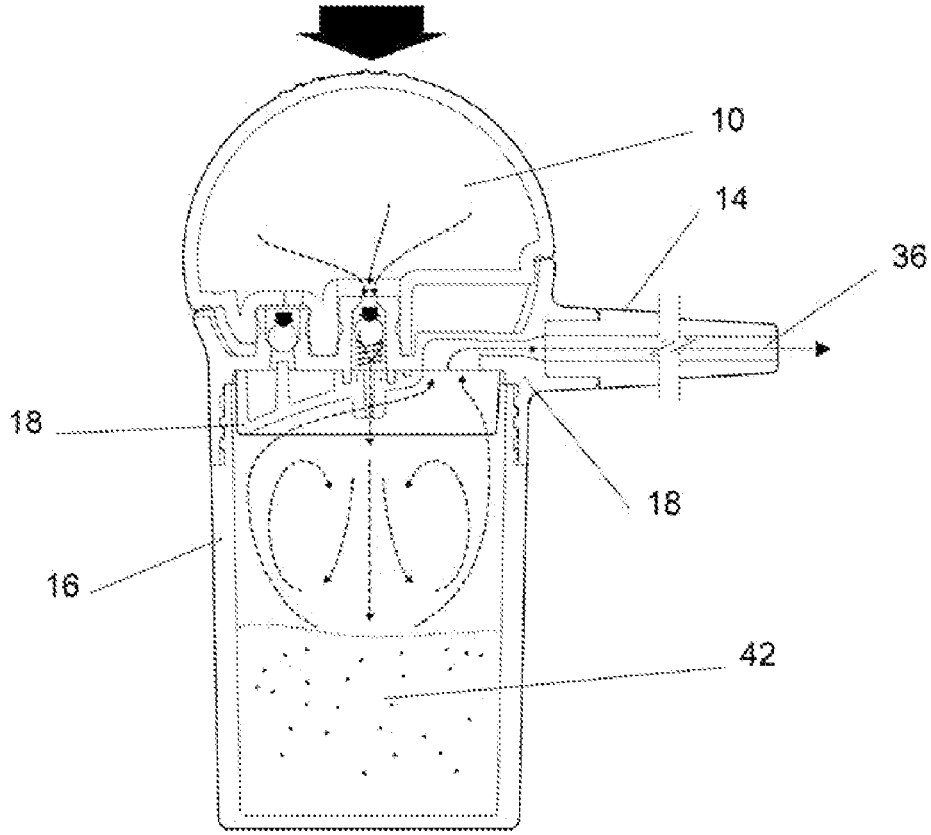
FIG. 5 is a cross-sectional diagram similar to FIG. 3 but showing air being expelled from the bulb during a dispensing operation.

The parts of the device can be better understood by reviewing their actions when the device is in use. FIG. 5 shows the device dispensing hair building solids 42 in response to the bulb 10 being depressed in the direction of the large arrow. Because the bulb 10 is directly on the dispenser body 12 as the bulb 10 is compressed, air is forced from the bulb (dotted arrows) through the opening 24 in the bulb wall and through the opening 22 in the valve seat 23. The force of the exiting air presses the valve ball 20 down against the spring 26 thus opening the one way air injecting valve, and the air rushes around the spring and through the air inlet nipple orifice 28. Note that the orifice is aimed directly at the surface of the hair building solids 42 within the container 16 to most effectively drive the solids into an air suspension. Unlike prior art designs where air from a bulb must follow a more or less tortious path to the hair building solids, here the air has a straight path from the bulb 10 to the solids 42.

Figure 4:
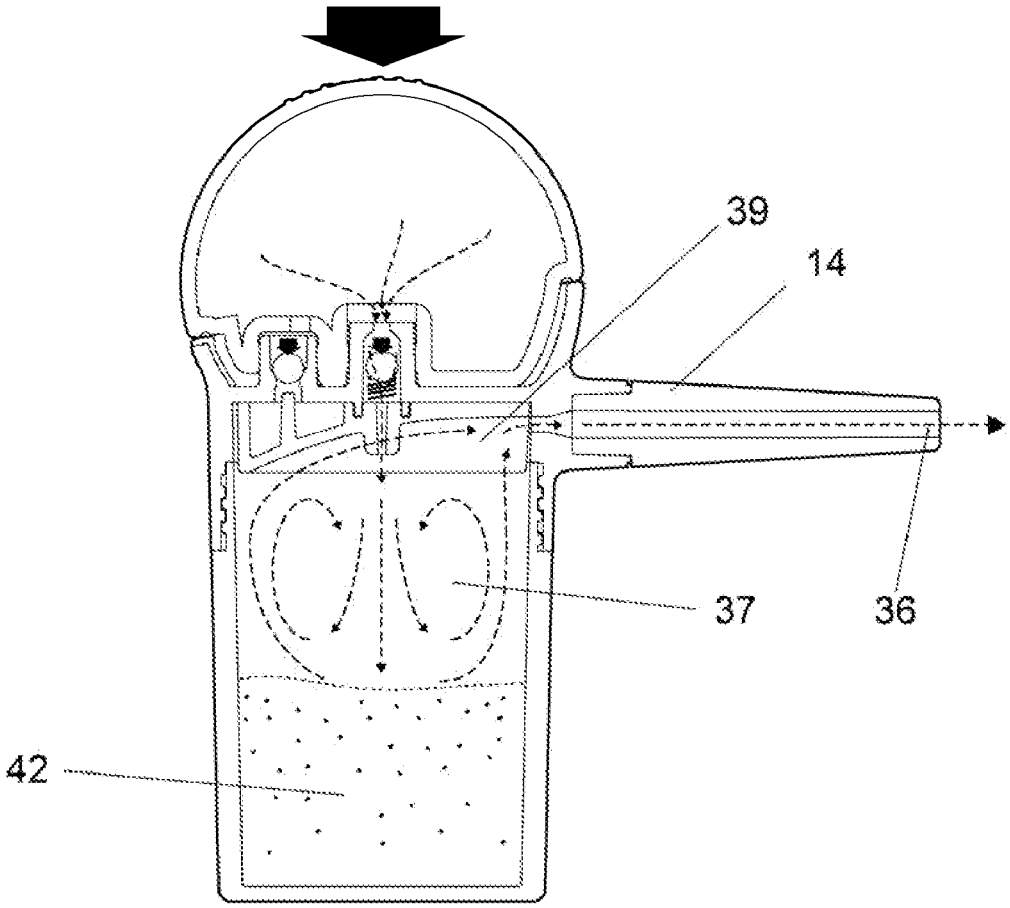
FIG. 4 is a cross-sectional view of a slightly different embodiment.

This direct path results in greater force air if the bulb 10 is depressed with maximum force as well as more fine control with less than maximum presses because there is less resistance and back-pressure in the straight airflow pathway from the bulb 10 to the solids 42. The ability to apply air with a greater force is particularly useful when the solids 42 are almost used up and the distance from the nipple 28 to the upper surface of the solids 42 is maximal. The air passing through the nipple 28 strikes and drives the hair building solids 42 into suspension (dotted arrows) within the turbulently pressurized inner space 37 of the container 16. The underside of the insert 18 is domed (see FIG. 7B) and forms a domed region 39. In some embodiments a transitional chamber 38 is molded into the dispenser body 12. Note that all the surfaces are smooth and the corners rounded. This minimizes turbulence in the airflow which can result in deposition of the suspended hair building solids 42. The orifice 36 in the nozzle 14 through which the suspended solids exit is a continuation of a bore or passageway that intersects a side wall of the transitional chamber 38. In an alternative embodiment (FIG. 4) the orifice 36 in the nozzle 14 enters directly into the domed region 39. Either embodiment avoids bends in the dispensing passageway; if the passageway has a bend, suspended solids may deposit at the bend (much as sand deposits at the bend in a stream) and clog the passageway. Here the air suspending the solids moves from a relatively large smooth chamber 38 into a smaller diameter passageway (leading to orifice 36) without any bends. As the air enters the smaller passageway, the velocity of the air accelerates (Venturi effect) thereby ensuring that the hair building solids remain in suspension and do not clog the airflow.

At the same time that the increased air pressure in the compressed bulb 10 opens the air injecting valve (ball 20 and valve seat 23) by pressing the ball 20 downwards against the spring 26, the compressed air in the bulb 10 also closes the refill valve. The air flowing through opening 34 presses the refill ball 30 down against its valve seat 32 thereby sealing that valve seat and preventing the exit of air through opening 34.

Figure 6B:
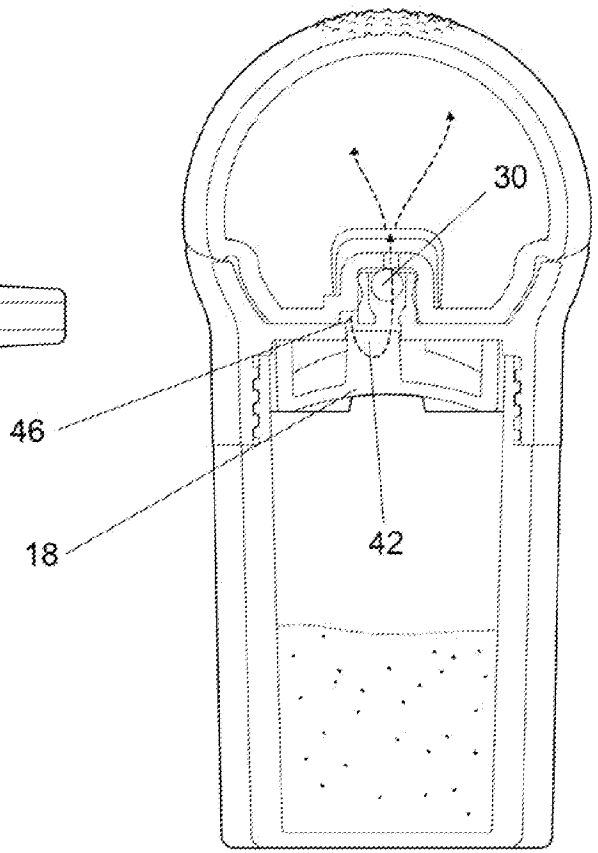
FIG. 6B shows a cross sectional diagram of the same device sectioned off the center plane of the device to show a different structure.
Figure 6A:
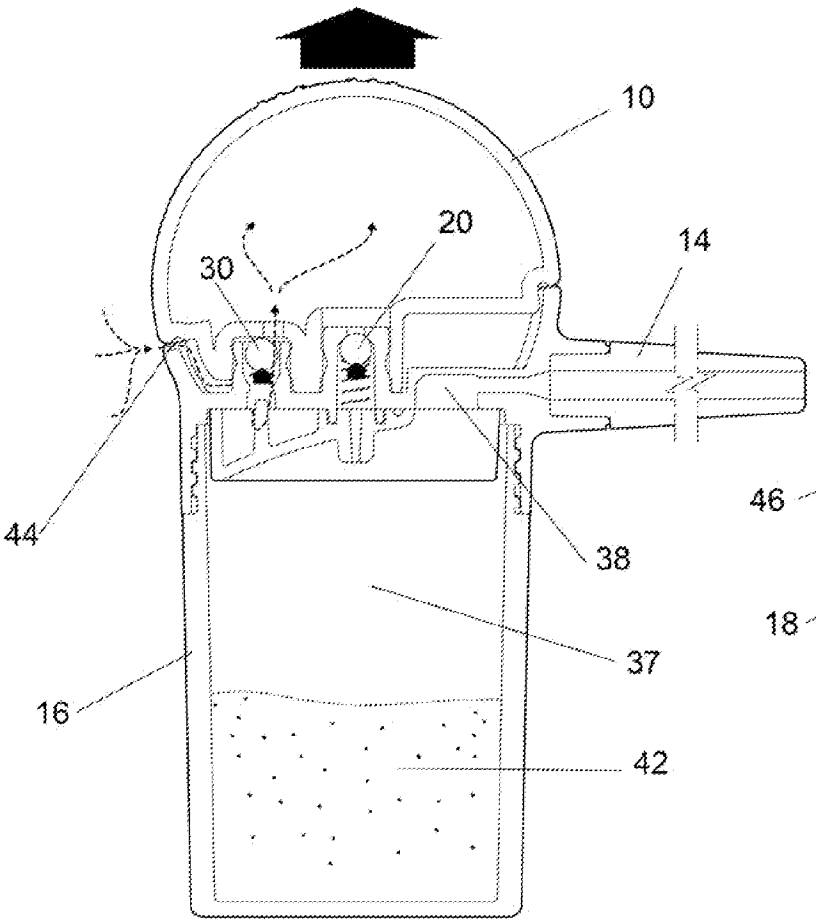
FIG. 6A is a cross sectional diagram similar to FIG. 3 but showing the bulb refilling with air after dispensing.

FIG. 6A illustrates the process of bulb refill when outside force is removed from the bulb 10. The elastic properties of the bulb 10 cause it to rebound to its original shape thereby drawing in air through the refill opening 34. The spring 26 forces the dispensing ball 20 against its seat 23 thereby preventing air and solids from being drawn from the container 16. The expansion of the bulb 10 reduces the air pressure within the bulb 10 causing atmospheric air to enter an external refill channel 44 between the bulb 10 and the dispenser body 12 and passing through an internal refill opening 46 in the dispenser body 12 adjacent the side of the refill valve seat 32 (see FIG. 5B) lifting refill ball 30 from the seat 32 thereby opening the refill valve. The incoming air flows around the ball 30 and enters the bulb 10 through the opening 34. The dispenser is now ready to be used to dispense more hair building solids.

To review, the dispenser design solves several problems experienced by earlier devices. First the location of the bulb 10 directly above the container 16 of hair building solids allows the device to be held, operated and aimed with one hand. The bulb 10 is located so as to enable it to be depressed by a single finger. When the compressed air exits the bulb it follows a direct straight pathway to the surface of the hair building solids 42. This avoids back pressure allowing both maximum force if needed as well as subtle control of smaller gentle puffs of air. The air exiting the air injecting nipple 28 suspends the hair building solids which are directed smoothly into the domed region 39. The suspended solids may directly exit the region 39 into a straight passageway continuous with the dispensing orifice 36. Alternatively, a transitional chamber 38 can be molded directly onto the domed region 39 with the suspended solids moving smoothly from the domed region 39 to the transitional chamber 38 and thence into the passageway continuous with the dispensing orifice 36. In either embodiment, there are no bends to result in clogging deposition of hair building solids. Finally, when the dispenser is grasped with one hand the index finger can readily be aligned with the short nozzle 14. Thus, when the dispenser is operated by depressing the index finger, the finger can naturally point to the location where the dispensed solids will be deposited. It is extremely natural for humans to point with their index fingers so that this arrangement conveniently allows a user to direct the dispensed solids to the desired location.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

We claim:

1. A dispenser for powder configured for one-handed operation comprising:

a dispenser body having a first end and a second end and configured so that one of the ends is attachable to a container of powder;

a hollow bulb of elastic, resilient material disposed on and attached to an end of the dispenser body opposite the end to which the container of powder is attachable, the bulb having an opening aligned with and in fluidic communication with an air injecting passageway approximately through a geometric center of the dispenser body so that when the bulb is depressed a current of air is expelled from the bulb and passes in a substantially straight line through the air injecting passageway to strike a surface of the powder when the container of powder is attached to the dispenser body thereby creating an air suspension of powder within a turbulently pressurized interior space of the container;

a one-way air injecting valve integral with and inline with the air injecting passageway which opens during dispensing and closes during refill of the bulb;

a one-way air refill valve integral with the dispenser body which opens to permit refilling of the bulb by air passing through a refill channel between the bulb and the dispenser body and closes during dispensing;

an insert fixed to the dispenser body, the insert forming a portion of the air injecting passageway with said air injecting valve captured between the insert and the dispenser body;

a continuous region beneath the dispenser body in direct fluidic communication with the interior space of the container of hair building solids attached to the dispenser body; and a nozzle projecting from the dispenser body having within a substantially straight passageway that directly opens into the continuous region, whereby when the container of powder is attached to the dispenser body, the container can be grasped by one hand leaving a finger free to depress the bulb thus creating an air suspension of powder within the interior space of the container whereupon the air suspension flows through the continuous region beneath the dispenser body straight into the passageway within the nozzle and exits an orifice thus dispensing the powder.

2. The dispenser according to claim 1 further comprising a transitional chamber in direct communication with the continuous region and in-between the continuous region and the passageway within the nozzle.

3. The dispenser according to claim 1, wherein said one-way valves are ball valves.

4. The dispenser according to claim 3, wherein said air injecting valve further comprises a spring.

5. The dispenser according to claim 1, wherein the powder comprises hair building solids.

* * * * *